US006194088B1

(12) United States Patent
Yoshida et al.

(10) Patent No.: US 6,194,088 B1
(45) Date of Patent: Feb. 27, 2001

(54) STAINLESS STEEL COATED WITH INTERMETALLIC COMPOUND AND PROCESS FOR PRODUCING THE SAME

(75) Inventors: Hiroaki Yoshida, Tokai; Hiroshi Yamada, Kasugai; Fumio Iwane, Nagoya; Junji Imai, Amagasaki; Tadashi Hamada, Sakai; Shinji Fujimoto, Hirakata; Shuji Yamada, Ashiya; Shigetoshi Sakon, Hirakata, all of (JP)

(73) Assignees: Daido Steel Co., Ltd., Nagoya; Matsushita Electric Works, Ltd., Osaka, both of (JP)

( * ) Notice: Subject to any disclaimer, the term of this patent is extended or adjusted under 35 U.S.C. 154(b) by 0 days.

(21) Appl. No.: 09/331,589

(22) PCT Filed: Nov. 11, 1998

(86) PCT No.: PCT/JP98/05082

§ 371 Date: Jul. 1, 1999

§ 102(e) Date: Jul. 1, 1999

(87) PCT Pub. No.: WO99/24633

PCT Pub. Date: May 20, 1999

(30) Foreign Application Priority Data

Dec. 11, 1997 (JP) ..... 9-329447

(51) Int. Cl.[7] ..... B32B 15/18; C22F 1/18; C22C 10/28

(52) U.S. Cl. ..... 428/660; 428/679; 428/685; 428/941; 148/530

(58) Field of Search ..... 428/685, 660, 428/679, 677, 682, 683, 941; 148/530, 532, 534, 537

(56) References Cited

U.S. PATENT DOCUMENTS

| | | | | |
|---|---|---|---|---|
| 2,786,265 | * | 3/1957 | Keay, Jr. | 428/660 |
| 3,015,885 | * | 1/1962 | McEuen et al. | 428/660 |
| 3,071,491 | * | 1/1963 | Horn et al. | 428/660 |
| 3,125,805 | * | 3/1964 | Horigan, Jr. | 428/660 |
| 3,615,902 | * | 10/1971 | Lesney | 148/12 |
| 4,485,149 | * | 11/1984 | Sprenger et al. | 428/627 |
| 4,612,259 | * | 9/1986 | Ueda | 428/661 |
| 4,839,242 | * | 6/1989 | Murayama et al. | 428/660 |
| 5,190,831 | * | 3/1993 | Banker | 428/660 |

FOREIGN PATENT DOCUMENTS

| | | | |
|---|---|---|---|
| 62-203687 | | 9/1987 | (JP) . |
| 63-318985 | * | 12/1988 | (JP) . |
| 1-35918 | | 7/1989 | (JP) . |
| 1-309791 | * | 12/1989 | (JP) . |
| 3-115559 | | 5/1991 | (JP) . |
| 10-29104 | * | 2/1998 | (JP) . |

* cited by examiner

*Primary Examiner*—John J. Zimmerman
(74) *Attorney, Agent, or Firm*—Arent Fox Kintner Plotkin & Kahn, PLLC

(57) ABSTRACT

An intermetallic-compound coated stainless steel having excellent rigidity, toughness, wear resistance and corrosion resistance comprises a substrate of a martensite stainless steel having a Vickers hardness of 400 or more, and a hard film having a bottom surface adhered to the substrate and an exposed top surface. The hard film has an outermost layer made of a compound selected from the group consisting of a Ti—Ni intermetallic compound, Ti—Fe intermetallic compound, and a mixture of the Ti—Ni intermetallic compound and a Ti—Cu intermetallic compound. The coated stainless steel can be produced by cladding an outer sheet made of Ti or a Ti alloy to a martensite stainless steel sheet directly or through an intermediate sheet made of Ni, Fe or a Ni—Cu alloy, heating the laminate at a temperature of 900° C. to 1150° C. for 30 seconds to 5 minutes, and then cooling the heated laminate at a cooling rate of 1° C./sec or more.

10 Claims, 4 Drawing Sheets

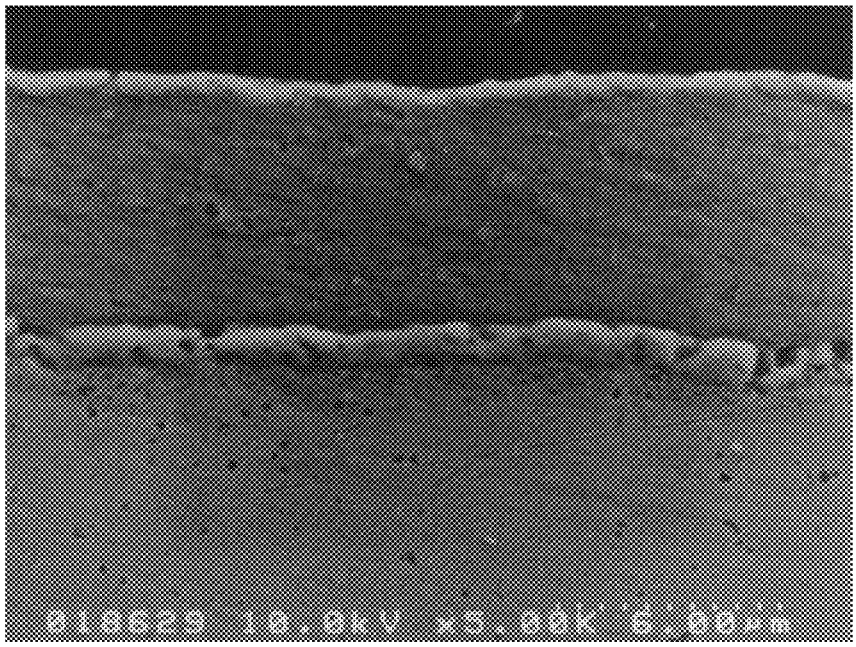
FIG. 4 6 μm
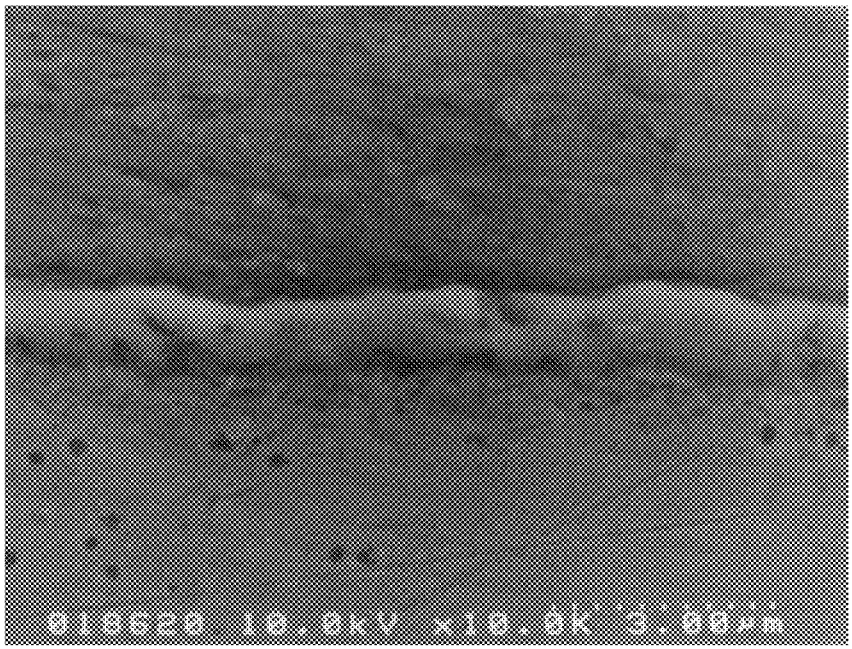
FIG. 5 3 μm

3 μm

3 μm

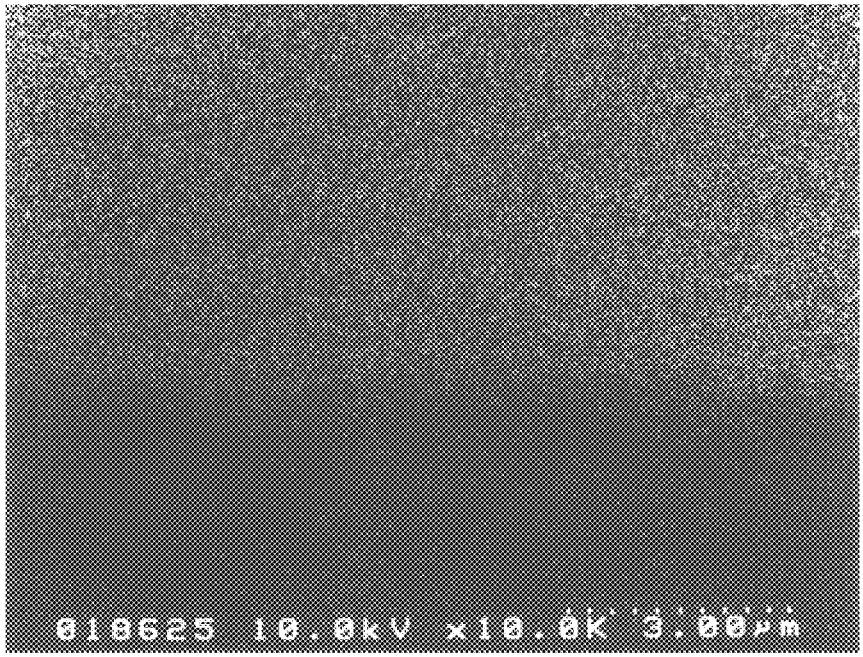
FIG. 8 3 μm
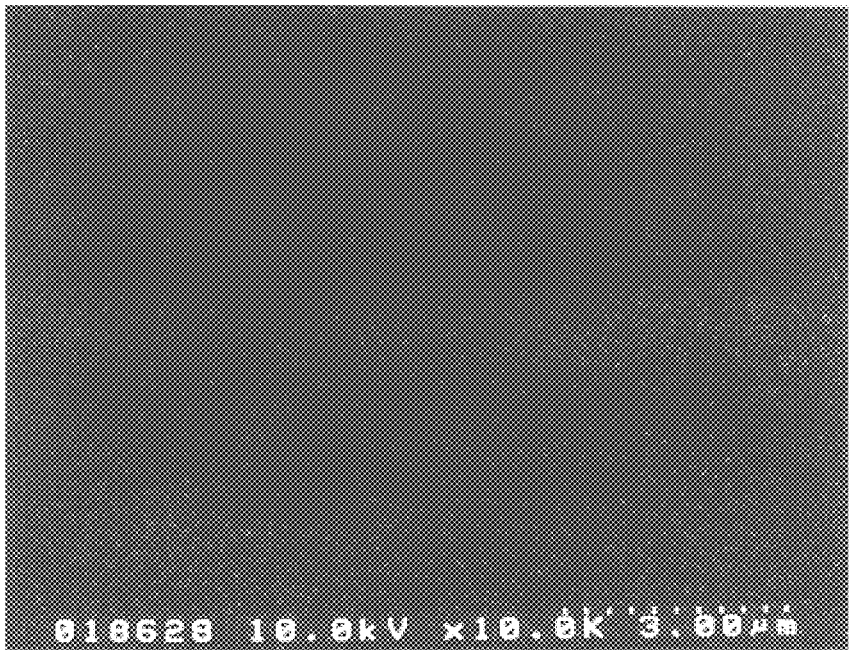
FIG. 9 3 μm

STAINLESS STEEL COATED WITH INTERMETALLIC COMPOUND AND PROCESS FOR PRODUCING THE SAME

BACKGROUND OF THE INVENTION

1. Field of the Invention

The present invention relates to an intermetallic-compound coated stainless steel, which can be used for parts requiring excellent rigidity, toughness, wear resistance and corrosion resistance, for example, structural parts such as gears and bearings, and cutting tools such as hair clippers and blades for electric shavers, and a method of producing the same.

2. Disclosure of the Prior Art

In the past, carbon tool steels, high carbon stainless steels, or precipitation-hardening stainless steels have been used to structural parts such as gears and bearings, and cutting tools such as hair clippers and blades for electric shavers. Although these materials are excellent in toughness, the wear resistance is not enough. To improve the wear resistance, conventional ceramics can be used. However, they have not been practical yet in applications requiring complex configuration or sharp edge because of poor toughness and workability of the ceramics. On the other hand, a surface modification of the foregoing steels can be performed by coating a hard material having excellent corrosion resistance such as alumina by means of physical vapor deposition (PVD) method or chemical vapor deposition (CVD). In this case, since a thickness of the coated hard material is very thin, for example, 0.1 $\mu$m, sufficient wear resistance has not been obtained yet. In addition, there is a problem that the adhesion between the coated hard material and the steels is not enough.

SUMMARY OF THE INVENTION

An object of the present invention is to provide an intermetallic-compound coated stainless steel having excellent rigidity, toughness, wear resistance and corrosion resistance. That is, the coated stainless steel comprises a substrate of a martensite stainless steel, and a hard film having a bottom surface adhered to the substrate and an exposed top surface. The stainless steel of the substrate has a Vickers hardness of 400 or more. The hard film has an outermost layer made of a compound selected from the group consisting of a Ti—Ni intermetallic compound, Ti—Fe intermetallic compound, and a mixture of the Ti—Ni intermetallic compound and a Ti—Cu intermetallic compound.

When the outermost layer is made of the Ti—Fe intermetallic compound, it is preferred that the hard film has a $TiFe_2$ layer, and a TiFe layer formed on the $TiFe_2$ layer as the outermost layer.

When the outermost layer is made of the Ti—Ni intermetallic compound, it is preferred that the hard film has a $TiNi_3$ layer, and a TiNi layer formed on the $TiNi_3$ layer as the outermost layer.

When the outermost layer is made of the mixture of the Ti—Ni intermetallic compound and the Ti—Cu intermetallic compound, it is preferred that the hard film has a mixture layer of TiNi and TiCu as the outermost layer.

A further object of the present invention is to provide a method of producing the intermetallic-compound coated stainless steel. That is, a laminate is prepared by cladding an outer sheet of Ti or a Ti alloy directly on a surface of the martensite stainless steel, or cladding the outer sheet on the martensite stainless steel through an intermediate sheet of Ni, Fe or a Ni—Cu alloy. Then, a quench hardening treatment is performed to the laminate. That is, the laminate is heated and kept at a temperature of 900° C. to 1150° C. for 30 seconds to 5 minutes, and then cooled at a cooling rate of 1° C./sec or more. By the quench hardening treatment, the stainless steel is hardened to a Vickers hardness of 400 or more, and at the same time the hard film is formed on the hardened stainless steel. When the laminate is prepared by cladding the outer sheet on the stainless steel sheet through the intermediate sheet, the hard film having the outermost layer made of an intermetallic compound between Ti of the outer sheet and the metal element of the intermediate sheet is formed on the stainless steel by the foregoing hardening treatment. On the other hand, when the laminate is prepared by cladding the outer sheet directly on the stainless steel sheet, the hard film having a TiC layer, a $TiFe_2$ layer formed on the TiC layer, and a TiFe layer formed on the $TiFe_2$ layer as the outermost layer, is formed on the stainless steel by the foregoing hardening treatment.

When using the intermediate sheet, it is preferred that a thickness of the outer sheet in the laminate is within a range of 1 to 10 $\mu$m and a thickness of the intermediate sheet in the laminate is 1 to 3 times of the thickness of the outer sheet.

In the above method, when the laminate is worked by a plastic deformation prior to the foregoing hardening treatment, it is preferred to perform the working after an annealing treatment in which the laminate is heated and kept at a temperature of 700° C. to 800° C. for 15 seconds to 2 minutes.

These and still other objects and advantages will become apparent from the following detail description of the preferred embodiments and examples of the invention referring to the attached drawings.

BRIEF DESCRIPTION OF THE DRAWINGS

FIG. 4 is a SEM photograph of a cross section of an intermetallic-compound coated stainless steel of Example 22;

FIG. 5 is a SEM photograph of an interface portion between a hard film and a stainless steel substrate of Example 22;

FIG. 8 is a photograph showing a distribution of Ti at the interface portion of FIG. 5; and FIG. 9 is a photograph showing a distribution of C at the interface portion of FIG. 5.

DETAIL DESCRIPTION OF THE PREFERRED EMBODIMENTS

Figure 1:
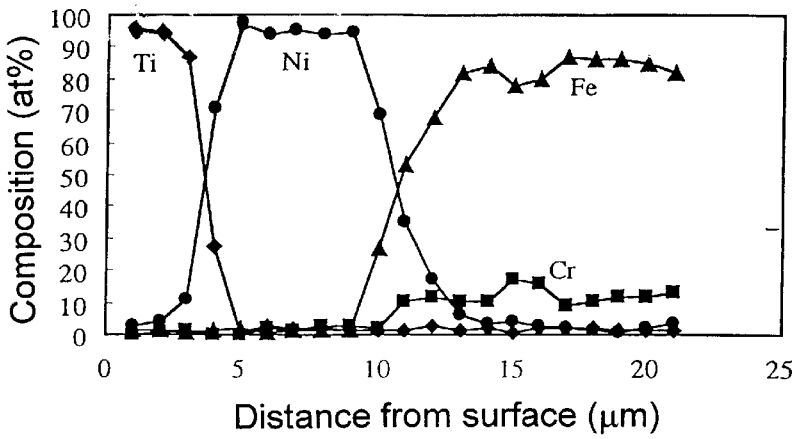
FIG. 1 is a diagram showing changes of Ti, Ni, Cr and Fe concentrations measured in the depth direction from a laminate surface before a quench hardening treatment of Example 1.

An intermetallic-compound coated stainless steel of the present invention comprises a substrate of a martensite stainless steel as a substrate, and a hard film having a bottom surface adhered to the substrate and an exposed top surface. The stainless steel of the substrate has a Vickers hardness of 400 or more. When the Vickers hardness is less than 400, the coated stainless steel of the present invention is not sufficient in hardness, strength and rigidity to use for structural parts such as gears and bearings, and cutting tools such as hair clippers and blades for electric shavers. In the present invention, it is preferred to use the martensite stainless steel having a composition of 12 to 20 wt % of Cr, 0.3 to 0.8 wt % of C, 2.5 wt % or less of Mo, and the balance of Fe. To achieve a quench hardening of the stainless steel by a thermal treatment explained later, it is required that the carbon content is 0.3 wt % or more. In addition, if necessary, required amounts of Si, Mn, V, and/or Nb may be added to the above composition.

The hard film has an outermost layer made of a compound selected from the group consisting of a Ti—Ni intermetallic compound, Ti—Fe intermetallic compound, and a mixture of the Ti—Ni intermetallic compound and a Ti—Cu intermetallic compound.

In case of the Ti—Ni intermetallic compound, it is preferred that the hard film has a $TiNi_3$ layer, and a TiNi layer formed on the $TiNi_3$ layer as the outermost layer. It is preferred that a total thickness of the $TiNi_3$ layer and TiNi layer is within a range of 1 to 15 $\mu$m. In case of using the intermetallic-compound coated stainless steel of the present invention for blades of an electric shaver, when the total thickness is less than 1 $\mu$m, an improvement of the wear resistance is small. On the other hand, when the total thickness is more than 15 $\mu$m, there is a possibility of causing chippings at the blades. Therefore, when the total thickness of the $TiNi_3$ layer and TiNi layer is within the above range, it is possible to provide excellent shaving performance over an extended time period while preventing the occurrence of the chippings.

In case of the Ti—Fe intermetallic compound, it is preferred that the hard film has a $TiFe_2$ layer, and a TiFe layer formed on the $TiFe_2$ layer as the outermost layer. From the same reason described above, it is preferred that a total thickness of the $TiFe_2$ layer and TiFe layer is within the range of 1 to 15 $\mu$m. In addition, under a specific condition explained later, it is preferred that the hard film has a TiC layer, a $TiFe_2$ layer formed on the TiC layer, and a TiFe layer formed on the $TiFe_2$ layer as the outermost layer. From the same reason described above, it is preferred that a total thickness of the Tic layer, $TiFe_2$ layer and the TiFe layer is within the range of 1 to 15 $\mu$m.

In case of the mixture of the Ti—Ni intermetallic compound and the Ti—Cu intermetallic compound, it is preferred that the hard film has a first mixture layer of TiNi and TiCu as the outermost layer. A second mixture layer of $TiNi_3$, $Ti_2Cu_3$, and $TiCu_2$ may be formed under the first mixture layer. From the same reason described above, it is preferred that a total thickness of the first and second mixture layers is within the range of 1 to 15 $\mu$m.

Next, first and second methods of producing the intermetallic-compound coated stainless steel of the present invention are explained. In the first method, a laminate is prepared by cladding an outer sheet of Ti or a Ti alloy on one side or both sides of a martensite stainless steel sheet through an intermediate sheet of Ni, Fe or a Ni—Cu alloy. As the Ti alloy, it is preferred to use a Ti—Pd alloy, e.g., Ti-0.15wt % Pd alloy, a Ti—Mo—Ni alloy, e.g., Ti- 0.3wt % Mo-0.8wt % Ni alloy, or a Ti—Ta alloy, e.g., Ti-5wt % Ta alloy. When using the Ni—Cu alloy as the intermediate sheet, it is preferred that the copper content is within a range of 10 to 35 wt %.

Then, a quench-hardening treatment is performed to the laminate. That is, the laminate is heated and kept at a temperature of 900° C. to 1150° C. for 30 seconds to 5 minutes, and then cooled at a cooling rate of 1° C./sec or more. In particular, it is preferred that the laminate is heated and kept at 1050° C. for 1 to 2 minutes, and then cooled at a cooling rate of 50° C./sec. By the quench-hardening treatment, the stainless steel is hardened to a Vickers hardness of 400 or more, and at the same time the hard film having the outermost layer made of the intermetallic compound between Ti of the outer sheet and Fe or Ni of the intermediate sheet, or the hard film having the outermost layer made of the mixture of the Ti—Ni intermetallic compound and the Ti—Cu intermetallic compound, is formed on the stainless steel.

When the treatment time is more than 5 minutes, Ti of the outer sheet diffuses into the stainless steel through the intermediate sheet, and reacts with carbon in the stainless steel to generate TiC, so that the carbon content in the stainless steel decreases. Due to the decrease of the carbon content, the quench-hardening of the substrate is not sufficiently achieved. In other words, the stainless steel having the Vickers hardness of 400 or more can not be obtained as the substrate supporting the hard film. In addition, when the treatment time is less than 30 seconds, it is difficult to uniformly perform the quench-hardening treatment to the laminate. As a result, the quench hardening of the substrate is not uniform, and the formation of the hard film is insufficient. When the treatment temperature is more than 1150° C., a diffusion rate of Ti increases, so that there causes a problem, which is the same as the problem occurring when the treatment time is more than 5 minutes.

On the other hand, when the treatment temperature is less than 900° C., the formation of the intermetallic compound of the hard film is insufficient, and the quench- hardening of the substrate can not be achieved. As a result, the stainless steel having the Vickers hardness of 400 or more can not be obtained. In addition, when using a slow cooling rate of less than 1° C./sec, the quench-hardening of the stainless steel can not be achieved. It is preferred to-perform this quench hardening treatment in vacuum, an inert gas atmosphere such as argon, or a reducing gas atmosphere.

In the second method, a laminate is prepared by cladding the outer sheet of Ti or the Ti alloy directly on one side or both sides of the martensite stainless steel sheet without using the intermediate sheet. The Ti alloy explained in the first method can be used in the second method. In addition, a quench-hardening treatment of the second method is the same as that of the first method. By this second method, the hard film having the TiC layer, the $TiFe_2$ layer formed on the TiC layer, and the TiFe layer formed on the $TiFe_2$ layer as the outermost layer is formed on the stainless steel.

One of the first and second methods is selected according to the following conditions.

(1) Thickness Ratio of Outer Sheet to Stainless Steel Sheet

The thickness ratio of the outer sheet (Ti or Ti alloy) to the stainless steel sheet in the laminate can be expressed by the following equation:

$$\alpha\ (\%)=100\times Ds/(Ds+DL)$$

wherein "Ds" is a one-half (½) thickness of the stainless steel sheet, and "DL" is a thickness of the outer sheet on one side of the stainless steel sheet in the laminate. When 85% >α, the first method is selected according to the following reason. In the heat treatment, a titanium carbide such as TiC is generated by a reaction between Ti of the outer sheet and C (carbon) contained in the stainless steel. When an excess amount of carbon of the stainless steel is used to the reaction with Ti, the quench-hardening effect to the stainless steel becomes to be insufficient, so that the substrate having the Vickers hardness of 400 or more can not be obtained. Therefore, in the first method, the intermediate sheet of Ni, Fe, or the Ni—Cu alloy is inserted between the stainless steel sheet and the outer sheet to control the generation of TiC. Additionally, this intermediate sheet reacts with Ti of the outer sheet to generate the intermetallic compound.

When the intermediate sheet of Fe is inserted, the Ti—Fe intermetallic compound layer is formed in the hard film by the reaction of Fe of the intermediate sheet with Ti during the heat treatment. Since this Ti—Fe intermetallic compound layer is adhered to the stainless steel through a diffusion layer formed by a mutual diffusion between Fe of the intermediate sheet and components of the stainless steel, the adhesion between the hard film and the stainless steel substrate is good. When the thickness of the Fe intermediate sheet is thick, a thin Fe layer may remain between the Ti—Fe intermetallic compound layer and this diffusion layer. When the intermediate sheet of Ni is inserted, the Ti—Ni intermetallic compound layer is formed in the hard film by the reaction of Ni of the intermediate sheet with Ti during the heat treatment. Since this Ti—Ni intermetallic compound layer is adhered to the stainless steel through a diffusion layer formed by a mutual diffusion between Ni of the intermediate sheet and components of the stainless steel, the adhesion between the hard film and the stainless steel substrate is good. When the thickness of the Ni intermediate sheet is thick, a thin Ni layer may remain between the Ti—Ni intermetallic compound layer and this diffusion layer.

In addition, when the intermediate sheet of the Ni—Cu alloy is inserted, the mixture layer of the Ti—Ni intermetallic compound and the Ti—Cu intermetallic compound is formed in the hard film by the reaction of Ni and Cu of the intermediate sheet with Ti during the heat treatment. Since this intermetallic compound layer is adhered to the stainless steel through a diffusion layer formed by a mutual diffusion between Ni and Cu of the intermediate sheet and components of the stainless steel, the adhesion between the hard film and the stainless steel substrate is good. When the thickness of the Ni—Cu alloy intermediate layer is thick, a thin Ni—Cu alloy layer may remain between the intermetallic compound layer and this diffusion layer.

On the other hand, when 85% $\leqq \alpha$, the second method is selected.

As described above, the generation of TiC is caused by the reaction between Ti of the outer sheet and C (carbon) of the stainless steel during the heat treatment. However, since the thickness of the outer sheet is much thinner than that of the stainless steel, only a small amount of carbon of the stainless steel is used for the TiC generation. This does not have an influence upon the quench-hardening treatment. As a result, as shown in FIG. 5, Ti of the outer sheet reacts with carbon of the stainless steel to generate a thin TiC layer, and also reacts with Fe of the stainless steel to generate the $TiFe_2$ layer and the TiFe layer during the heat treatment. An adhesion between the hard film and the stainless steel substrate is good because a mutual diffusion between Ti of the outer sheet and the components of the stainless steel is caused by the heat treatment.

(2) Carbon Content in Martensite Stainless Steel

In case that the carbon content in the martensite stainless steel is less than 0.5 wt %, when carbon of the stainless steel is consumed by the TiC generation during the heat treatment, it is difficult to achieve the quench hardening treatment. Therefore, to control the reaction of Ti of the outer sheet with carbon of the stainless steel, it is necessary to insert the intermediate sheet of Fe, Ni, or the Ni—Cu alloy between the stainless steel sheet and the outer sheet. For this reason, the first method is selected. On the other hand, when the carbon content of the stainless steel is 0.5 wt % or more, the quench hardening treatment can be achieved even when carbon of the stainless steel is consumed to some extent by the TiC generation during the heat treatment. Therefore, the use of the intermediate sheet is not always required, so that the second method is selected.

In the present specification, as an example, 85% of the thickness ratio ($\alpha$) and 5 % of the carbon content in the martensite stainless steel are used as threshold values for deciding the use of either the first method or the second method. However, the thickness ratio and the carbon content are not always limited to these numerical values. According to the actual shape and size of manufactured articles, some changes may be made in those values.

Thus, in case of producing the intermetallic-compound coated stainless steel of the present invention, when a decision that it will be difficult to achieve the quench hardening treatment to obtain the substrate having the Vickers hardness of 400 or more is brought by at least one of the above items (1) and (2), the first method is selected.

In each of the first and second methods, it is preferred that the thickness of the outer sheet in the laminate is within a range of 1 to 10 $\mu$m. To give excellent wear resistance to the intermetallic-compound coated stainless steel, it is preferred that the thickness of the outer sheet is 1 $\mu$m or more. In the first method using the intermediate sheet, it is preferred that thickness of the intermediate sheet in the laminate is 1 to 3 times of that of the outer sheet.

In each of the first and second methods, when the heat treatment for obtaining the hard film is performed after the laminate is worked to a desired shape by. plastic deformation, for example, bending or drawing, it is preferred to perform an annealing treatment to the laminate prior to the plastic deformation. That is, due to work hardening caused by the cladding, it is difficult to perform the plastic deformation to the laminate. As the annealing treatment, the laminate is heated and kept at a temperature of 700° C. to 800° C. for 15 seconds to 2 minutes, and then cooled.

When the annealing temperature is less than 700° C., it is insufficient to remove the work hardening from the laminate. When the annealing temperature is more than 800° C., there is a possibility that cracks occur in a surface of the laminate during the plastic deformation because the generation of the intermetallic compound begins in the laminate. On the other hand, when the annealing time is less than 15 seconds, the work hardening can not be uniformly removed from the laminate, and flaking or cracks easily occur during the plastic deformation. When the annealing time is more than 2 minutes, there cause a problem, which is the same as the problem occurring when the annealing temperature is more than 800° C.

EXAMPLES

The present invention is concretely explained according to the following Examples. Compositions of stainless steel sheets and alloy sheets used in the Examples are based on weight %. Layer thickness and hardness of an intermetallic-compound coated stainless steel of each of the Examples and Comparative Examples are shown in Tables 1 and 3. Producing conditions of the intermetallic-compound coated stainless steels are shown in Tables 2 and 4.

EXAMPLE 1

Figure 2:
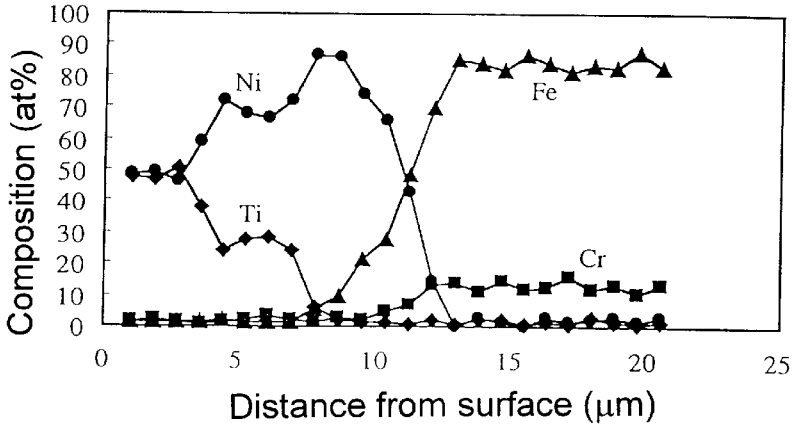
FIG. 2 is a diagram showing changes of Ti, Ni, Cr and Fe concentrations measured in the depth direction from a hard film surface after the quench hardening treatment of Example 1.
Figure 3:
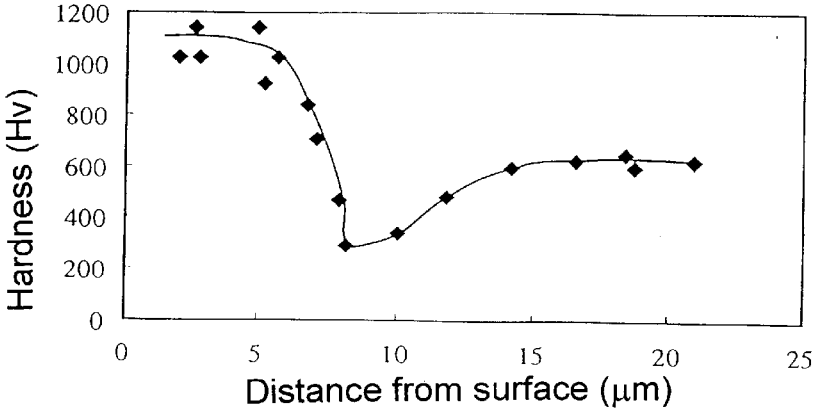
FIG. 3 is a diagram showing a hardness change measured in the depth direction from a surface of an intermetallic-compound coated stainless steel of Example 1.
Figure 6:
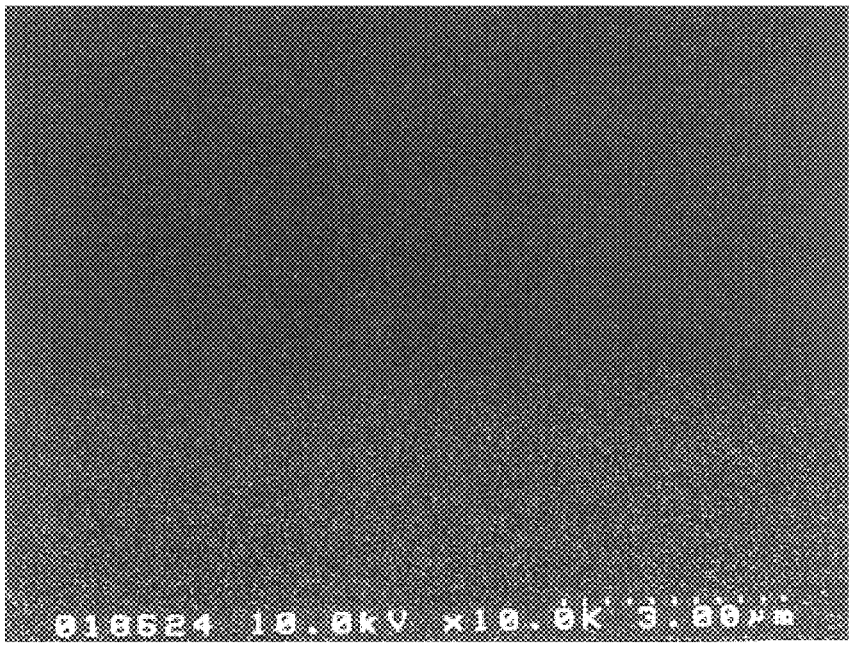
FIG. 6 is a photograph showing a distribution of Fe at the interface portion of FIG. 5.
Figure 7:
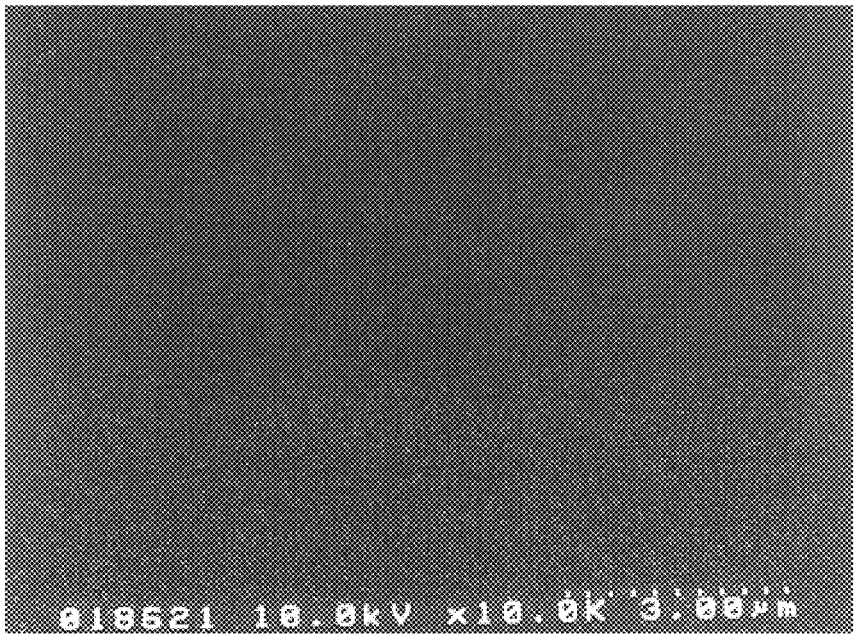
FIG. 7 is a photograph showing a distribution of Cr at the interface portion of FIG. 5.

A martensite stainless steel having the composition shown in Table 1 was used as a substrate. A Ni sheet was placed on one side of the substrate, and also a Ti sheet was placed on the Ni sheet. These piled-up sheets were clad to the substrate by rolling to obtain a laminate. The laminate is further rolled to adjust a total thickness of the laminate. As a result, the total thickness of the laminate is 0.1 mm, in which a thickness of the Ni sheet as an intermediate layer is 8 μm, and a thickness of the Ti sheet as an outer layer is 3 μm. After an annealing treatment was performed to the laminate at 700° C. for 2 minutes, the laminate was worked to a desired shape by bending. Subsequently, the worked laminate was heated at 1050° C. for 2 minutes in an atmosphere of Ar (99.99%), and then cooled at a cooling rate of 50° C./sec. By this heat treatment, the stainless steel was quench-hardened to a Vickers hardness of 600, and at the same time, a TiNi layer having a thickness of 3 μm as an outermost layer, a $TiNi_3$ layer having a thickness of 4 μm formed under the TiNi layer as a second layer, and a diffusion layer having a thickness of 4 μm formed under the $TiNi_3$ layer by a mutual diffusion between the stainless steel and the Ni sheet, were obtained on the stainless steel. FIG. 1 shows a result of EPMA performed with respect to a depth direction from the laminate surface before the heat treatment. FIG. 2 shows a result of EPMA performed with respect to the depth direction from the laminate surface after the heat treatment. FIG. 2 indicates that an atomic ratio of Ni:Ti of the outermost layer is about 1:1, and the second layer having the atomic ratio of Ni:Ti of about 3:1 is formed under the outermost layer. In addition, a hardness change measured in the depth direction from the surface of the hard film is shown in FIG. 3.

EXAMPLE 2

A martensite stainless steel having the composition shown in Table 1 was used as a substrate. Ni sheets were placed on both sides of the substrate, and also Ti sheets were placed on the respective Ni sheets. These piled-up sheets were clad to the substrate by rolling to obtain a laminate. The laminate is further rolled to adjust a total thickness of the laminate. As a result, the total thickness of the laminate is 0.05 mm, in which a thickness of the Ni sheet as an intermediate layer is 5 μm, and a thickness of the Ti sheet as an outer layer is 3 μm. After an annealing treatment was performed to the laminate at 700° C. for 30 seconds, the laminate was worked to a desired shape by bending. Subsequently, the worked laminate was heated at 1130° C. for 30 seconds in an atmosphere of Ar (99.99%), and then cooled at a cooling rate of 50° C./sec. By this heat treatment, the stainless steel was quench-hardened, and at the same time, a TiNi layer having a thickness of 3 μm as an outermost layer, a $TiNi_3$ layer having a thickness of 4 μm formed under the TiNi layer as a second layer, and a diffusion layer having a thickness of 1 μm formed under the $TiNi_3$ layer by a mutual diffusion between the stainless steel and the Ni sheet, were obtained on the stainless steel.

EXAMPLE 3

A martensite stainless steel having the composition shown in Table 1 was used as a substrate. Ni sheets were placed on both sides of the substrate, and also Ti-0.2% Pd alloy sheets were placed on the respective Ni sheets. These piled-up sheets were clad to the substrate by rolling to obtain a laminate. The laminate is further rolled to adjust a total thickness of the laminate. As a result, the total thickness of the laminate is 0.1 mm, in which a thickness of the Ni sheet as an intermediate layer is 13 μm, and a thickness of the Ti alloy sheet as an outer layer is 5 μm. After an annealing treatment was performed to the laminate at 750° C. for 1 minute, the laminate was worked to a desired shape by drawing. Subsequently, the worked laminate was heated at 1000° C. for 5 minutes in an atmosphere of Ar (99.99%), and then cooled at a cooling rate of 1° C./sec. By this heat treatment, the stainless steel was quench-hardened, and at the same time, a TiNi layer having a thickness of 5 μm as an outermost layer, a $TiNi_3$ layer having a thickness of 7 μm formed under the TiNi layer as a second layer, and a diffusion layer having a thickness of 7 μm formed under the $TiNi_3$ layer by a mutual diffusion between the stainless steel and the Ni sheet, were obtained on the stainless steel.

EXAMPLE 4

A martensite stainless steel having the composition shown in Table 1 was used as a substrate. Ni sheets were placed on both sides of the substrate, and also Ti sheets were placed on the respective Ni sheets. These piled-up sheets were clad to the substrate by rolling to obtain a laminate. The laminate is further rolled to adjust a total thickness of the laminate. As a result, the total thickness of the laminate is 0.08 mm, in which a thickness of the Ni sheet as an intermediate layer is 6 μm, and a thickness of the Ti sheet as an outer layer is 3 μm. After an annealing treatment was performed to the laminate at 800° C. for 15 seconds, the laminate was worked to a desired shape by bending. Subsequently, the worked laminate was heated at 930° C. for 5 minutes in an atmosphere of Ar (99.99%), and then cooled at a cooling rate of 20° C./sec. By this heat treatment, the stainless steel was quench-hardened, and at the same time, a TiNi layer having a thickness of 3 μm as an outermost layer, a $TiNi_3$ layer having a thickness of 4 μm formed under the TiNi layer as a second layer, and a diffusion layer having a thickness of 3 μm formed under the $TiNi_3$ layer by a mutual diffusion between the stainless steel and the Ni sheet, were obtained on the stainless steel.

EXAMPLE 5

A martensite stainless steel having the composition shown in Table 1 was used as a substrate. Ni sheets were placed on both sides of the substrate, and also Ti sheets were placed on the respective Ni sheets. These piled-up sheets were clad to the substrate by rolling to obtain a laminate. The laminate is further rolled to adjust a total thickness of the laminate. As a result, the total thickness of the laminate is 0.1 mm, in which a thickness of the Ni sheet as an intermediate layer is 3 μm, and a thickness of the Ti sheet as an outer layer is 3 μm. After an annealing treatment was performed to the laminate at 800° C. for 30 seconds, the laminate was worked to a desired shape by drawing. Subsequently, the worked laminate was heated at 1000° C. for 2 minutes in an atmosphere of Ar (99.99%), and then cooled at a cooling rate of 10° C./sec. By this heat treatment, the stainless steel was quench-hardened, and at the same time, a TiNi layer having a thickness of 2 μm as an outermost layer, a $TiNi_3$ layer having a thickness of 3 μm formed under the TiNi layer as a second layer, and a diffusion layer having a thickness of 1 μm formed under the $TiNi_3$ layer by a mutual diffusion between the stainless steel and the Ni sheet, were obtained on the stainless steel.

EXAMPLE 6

A martensite stainless steel having the composition shown in Table 1 was used as a substrate. Ni sheets were placed on both sides of the substrate, and also Ti sheets were placed on the respective Ni sheets. These piled-up sheets were clad to the substrate by rolling to obtain a laminate. The laminate is further rolled to adjust a total thickness of the laminate. As a result, the total thickness of the laminate is 0.1 mm, in which a thickness of the Ni sheet as an intermediate layer is 5 μm, and a thickness of the Ti sheet as an outer layer is 3 μm. After an annealing treatment was performed to the laminate at 800° C. for 1 minute, the laminate was worked to a desired shape by bending. Subsequently, the worked laminate was heated at 1050° C. for 2 minutes in an atmosphere of Ar (99.99%), and then cooled at a cooling rate of 5° C./sec. By this heat treatment, the stainless steel was quench-hardened, and at the same time, a TiNi layer having a thickness of 3 μm as an outermost layer, a $TiNi_3$ layer having a thickness of 4 μm formed under the TiNi layer as a second layer, and a diffusion layer having a thickness of 1 μm formed under the $TiNi_3$ layer by a mutual diffusion between the stainless steel and the Ni sheet, were obtained on the stainless steel.

EXAMPLE 7

A martensite stainless steel having the composition shown in Table 1 was used as a substrate. Ni sheets were placed on both sides of the substrate, and also Ti sheets were placed on the respective Ni sheets. These piled-up sheets were clad to the substrate by rolling to obtain a laminate. The laminate is further rolled to adjust a total thickness of the laminate. As a result, the total thickness of the laminate is 0.2 mm, in which a thickness of the Ni sheet as an intermediate layer is 35 μm, and a thickness of the Ti sheet as an outer layer is 10 μm. Subsequently, the laminate was heated at 1050° C. for 3 minutes in an atmosphere of Ar (99.99%), and then cooled at a cooling rate of 10° C./sec. By this heat treatment, the stainless steel was quench-hardened, and at the same time, a TiNi layer having a thickness of 10 μm as an outermost layer, a $TiNi_3$ layer having a thickness of 12 μm formed under the TiNi layer as a second layer, and a diffusion layer having a thickness of 23 μm formed under the $TiNi_3$ layer by a mutual diffusion between the stainless steel and the Ni sheet, were obtained on the stainless steel.

EXAMPLE 8

A martensite stainless steel having the composition shown in Table 1 was used as a substrate. Fe sheets were placed on both sides of the substrate, and also Ti sheets were placed on the respective Fe sheets. These piled-up sheets were clad to the substrate by rolling to obtain a laminate. The laminate is further rolled to adjust a total thickness of the laminate. As a result, the total thickness of the laminate is 0.05 mm, in which a thickness of the Fe sheet as an intermediate layer is 4 μm, and a thickness of the Ti sheet as an outer layer is 4 μm. After an annealing treatment was performed to the laminate at 800° C. for 30 seconds, the laminate was worked to a desired shape by drawing. Subsequently, the worked laminate was heated at 950° C. for 2 minutes in an atmosphere of Ar (99.99%), and then cooled at a cooling rate of 10° C./sec. By this heat treatment, the stainless steel was quench-hardened, and at the same time, a TiFe layer having a thickness of 4 μm as an outermost layer, a $TiFe_2$ layer having a thickness of 3 μm formed under the TiFe layer as a second layer, and a diffusion layer having a thickness of 1 μm formed under the $TiFe_2$ layer by a mutual diffusion between the stainless steel and the Fe sheet, were obtained on the stainless steel.

EXAMPLE 9

A martensite stainless steel having the composition shown in Table 1 was used as a substrate. Fe sheets were placed on both sides of the substrate, and also Ti sheets were placed on the respective Fe sheets. These piled-up sheets were clad to the substrate by rolling to obtain a laminate. The laminate is further rolled to adjust a total thickness of the laminate. As a result, the total thickness of the laminate is 0.1 mm, in which a thickness of the Fe sheet as an intermediate layer is. 8 μm, and a thickness of the Ti sheet as an outer layer is 4 μm. After an annealing treatment was performed to the laminate at 750° C. for 1 minute, the laminate was worked to a desired shape by bending. Subsequently, the worked laminate was heated at 1050° C. for i minute in an atmosphere of Ar (99.99%), and then cooled at a cooling rate of 5° C./sec. By this heat treatment, the stainless steel was quench-hardened, and at the same time, a TiFe layer having a thickness of 4 μm as an outermost layer, a $TiFe_2$ layer having a thickness of 5 μm formed under the TiFe layer as a second layer, and a diffusion layer having a thickness of 3 μm formed under the $TiFe_2$ layer by a mutual diffusion between the stainless steel and the Fe sheet, were obtained on the stainless steel.

EXAMPLE 10

A martensite stainless steel having the composition shown in Table 1 was used as a substrate. Fe sheets were placed on both sides of the substrate, and also Ti sheets were placed on the respective Fe sheets. These piled-up sheets were clad to the substrate by rolling to obtain a laminate. The laminate is further rolled to adjust a total thickness of the laminate. As a result, the total thickness of the laminate is 0.3 mm, in which a thickness of the Fe sheet as an intermediate layer is 25 μm, and a thickness of the Ti sheet as an outer layer is 10 μm. After an annealing treatment was performed to the laminate at 800° C. for 2 minutes, the laminate was worked to a desired shape by bending. Subsequently, the worked laminate was heated at 1150° C. for 30 seconds in an atmosphere of Ar (99.99%), and then cooled at a cooling rate of 10 ° C./sec. By this heat treatment, the stainless steel was quench-hardened, and at the same time, a TiFe layer having a thickness of 10 μm as an outermost layer, a $TiFe_2$ layer having a thickness of 9 μm formed under the TiFe layer as a second layer, and a diffusion layer having a thickness of 6 μm formed under the $TiFe_2$ layer by a mutual diffusion between the stainless steel and the Fe sheet, were obtained on the stainless steel.

EXAMPLE 11

A martensite stainless steel having the composition shown in Table 1 was used as a substrate. A Ni-20% Cu alloy sheet was placed on one side of the substrate, and also a Ti sheet was placed on the alloy sheet. These piled-up sheets were clad to the substrate by rolling to obtain a laminate. The laminate is further rolled to adjust a total thickness of the laminate. As a result, the total thickness of the laminate is 0.05 mm, in which a thickness of the Ni-20% Cu alloy sheet as an intermediate layer is 5 μm, and a thickness of the Ti sheet as an outer layer is 2 μm. Subsequently, the laminate was heated at 1050° C. for 2 minutes in an atmosphere of Ar (99.99%), and then cooled at a cooling rate of 25° C./sec. By this heat treatment, the stainless steel was quench-hardened, and at the same time, a mixture layer of TiNi and TiCu having a thickness of 2 μm as an outermost layer, a mixture layer of $TiNi_3$, $Ti_2Cu_3$, and $TiCu_2$ having a thickness of 3 μm formed under the outermost layer as a second layer, and a diffusion layer having a thickness of 2 μm formed under the second layer by a mutual diffusion between the stainless steel and the Ni—Cu alloy sheet, were obtained on the stainless steel.

EXAMPLE 12

A martensite stainless steel having the composition shown in Table 1 was used as a substrate. A Ni—25% Cu alloy sheet was placed on one side of the substrate, and also a Ti-0.2% Pd alloy sheet was placed on the Ni—Cu alloy sheet. These piled-up sheets were clad to the substrate by rolling to obtain a laminate. The laminate is further rolled to adjust a total thickness of the laminate. As a result, the total thickness of the laminate is 0.09 mm, in which a thickness of the Ni—Cu alloy sheet as an intermediate layer is 4 μm, and a thickness of the Ti—Pd alloy sheet as an outer layer is 4 μm. Subsequently, the laminate was heated at 1000° C. for 30 seconds in an atmosphere of Ar (99.99%), and then cooled at a cooling rate of 1° C./sec. By this heat treatment, the stainless steel was quench-hardened, and at the same time, a mixture layer of TiNi and TiCu having a thickness of 3 μm as an outermost layer, a mixture layer of $TiNi_3$, $Ti_2Cu_3$, and $TiCu_2$ having a thickness of 4 μm formed under the outermost layer as a second layer, and a diffusion layer having a thickness of 1 μm formed under the second layer by a mutual diffusion between the stainless steel and the Ni—Cu alloy sheet, were obtained on the stainless steel.

EXAMPLE 13

A martensite stainless steel having the composition shown in Table 1 was used as a substrate. A Ni-15% Cu alloy sheet was placed on one side of the substrate, and also a Ti sheet was placed on the Ni—Cu alloy sheet. These piled-up sheets were clad to the substrate by rolling to obtain a laminate. The laminate is further rolled to adjust a total thickness of the laminate. As a result, the total thickness of the laminate is 0.04 mm, in which a thickness of the Ni—Cu alloy sheet as an intermediate layer is 8 μm, and a thickness of the Ti sheet as an outer layer is 2 μm. Subsequently, the laminate was heated at 1100° C. for 5 minutes in an atmosphere of Ar (99.99%), and then cooled at a cooling rate of 10° C./sec. By this heat treatment, the stainless steel was quench-hardened, and at the same time, a mixture layer of TiNi and TiCu having a thickness of 2 μm as an outermost layer, a mixture layer of $TiNi_3$, $Ti_2Cu_3$, and $TiCu_2$ having a thickness of 3 μm formed under the outermost layer as a second layer, and a diffusion layer having a thickness of 5 μm formed under the second layer by a mutual diffusion between the stainless steel and the Ni—Cu alloy sheet, were obtained on the stainless steel.

COMPARATIVE EXAMPLE 1

The same laminate as Example 2 was prepared. After the same annealing treatment as Example 2 was performed to the laminate, the laminate was worked to a desired shape by bending. Subsequently, the laminate was heated at 1170° C. for 30 seconds in an atmosphere of Ar (99.99%), and then cooled at a cooling rate of 50° C./sec. By this heat treatment, a TiNi layer having a thickness of 3 μm as an outermost layer, and a $TiNi_3$ layer having a thickness of 4 μm formed under the TiNi layer as a second layer were obtained on the stainless steel. However, the generation of a diffusion layer was not observed between the $TiNi_3$ layer and the stainless steel. In addition, the stainless steel was not quench-hardened to a Vickers hardness of 400 or more. As the reason, it is believed that since the heat treatment temperature is higher than 1150° C., Ti of an outer layer diffused into the stainless steel through an intermediate layer of Ni, and reacted with carbon of the stainless steel, so that the carbon content in the stainless steel decreased.

COMPARATIVE EXAMPLE 2

The same laminate as Example 2 was prepared. After the same annealing treatment as Example 2 was performed to the laminate, the laminate was worked to a desired shape by bending. Subsequently, the laminate was heated at 850° C. for 5 minutes in an atmosphere of Ar (99.99%), and then cooled at a cooling rate of 50° C./sec. By this heat treatment, a TiNi layer having a thickness of 2 μm as an outermost layer, a $TiNi_3$ layer having a thickness of 3 μm formed under the TiNi layer, and a diffusion-layer having a thickness of 3 μm formed under the $TiNi_3$ layer by a mutual diffusion between the stainless steel and the Ni sheet, were obtained on the stainless steel. However, since the thermal treatment was performed at such a low temperature, the stainless steel could not be quench-hardened to a Vickers hardness of 400 or more.

COMPARATIVE EXAMPLE 3

The same laminate as Example 2 was prepared. After the same annealing treatment as Example 2 was performed to the laminate, the laminate was worked to a desired shape by bending. Subsequently, the laminate was heated at 1050° C. for 15 seconds in an atmosphere of Ar (99.99%), and then cooled at a cooling rate of 50° C./sec. By this heat treatment, a TiNi layer having a thickness of 2 μm as an outermost layer, a $TiNi_3$ layer having a thickness of 3 μm formed under the TiNi layer, and a diffusion layer having a thickness of 3 μm formed under the $TiNi_3$ layer by a mutual diffusion between the stainless steel and the Ni sheet, were obtained on the stainless steel. However, since the thermal treatment was performed for such a short time period, the laminate could not be uniformly heated. As a result, the stainless steel could not be quench-hardened to a Vickers hardness of 400 or more.

COMPARATIVE EXAMPLE 4

The same laminate as Example 2 was prepared. After the same annealing treatment as Example 2 was performed to the laminate, the laminate was worked to a desired shape by bending. Subsequently, the laminate was heated at 1050° C. for 8 minutes in an atmosphere of Ar (99.99%), and then cooled at a cooling rate of 50° C./sec. By this heat treatment, a TiNi layer having a thickness of 3 μm as an outermost layer, and a $TiNi_3$ layer having a thickness of 4 μm formed under the TiNi layer were obtained on the stainless steel. However, the generation of a diffusion layer was not observed between the $TiNi_3$ layer and the stainless steel. In addition, the stainless steel was not quench-hardened to a Vickers hardness of 400 or more. As the reason, it is believed that since the thermal treatment was performed at 1050° C. for such an extended time period, Ti of an outer layer diffused into the stainless steel through an intermediate layer of Ni, and reacted with carbon of the stainless steel, so that the carbon content in the stainless steel decreased.

COMPARATIVE EXAMPLE 5

The same laminate as Example 2 was prepared. After an annealing treatment was performed to the laminate at 650° C. for 2 minutes in an atmosphere of Ar (99.99%), the laminate was worked to a desired shape by bending. However, since work hardening caused by the rolling at the preparation of the laminate was not sufficiently removed from the laminate by the annealing treatment, cracks occurred at the worked portions of the laminate. Therefore, a heat treatment for forming a hard film was not carried out.

COMPARATAIVE EXAMPLE 6

The same laminate as Example 2 was prepared. After an annealing treatment was performed to the laminate at 850°

C. for 5 seconds in an atmosphere of Ar (99.99%), the laminate was worked to a desired shape by drawing. However, since work hardening caused by the rolling at the preparation of the laminate was not sufficiently removed from the laminate by the annealing treatment, cracks occurred at the worked portions of the laminate. Therefore, a heat treatment for forming a hard film was not carried out.

COMPARATIVE EXAMPLE 7

The same laminate as Example 2 was prepared. After the same annealing treatment as Example 2 was performed to the laminate, the laminate was worked to a desired shape by bending. Subsequently, the laminate was heated at 1130° C. for 30 seconds in an atmosphere of Ar (99.99%), and then cooled at a cooling rate of 0.5° C./sec. By this heat treatment, a TiNi layer having a thickness of 3 μm as an outermost layer, a $TiNi_3$ layer having a thickness of 4 μm formed under the TiNi layer, and a diffusion layer having a thickness of 1 μm formed under the $TiNi_3$ layer by a mutual diffusion between the stainless steel and the Ni sheet, were obtained on the stainless steel. However, since the cooling rate was too slow, the stainless steel could not be quench-hardened to a Vickers hardness of 400 or more.

EXAMPLE 14

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.2 mm, in which a thickness of the Ti sheet is 5 μm. Subsequently, the laminate was heated at 950° C. for 1 minute in an atmosphere of Ar (99.99%), and then cooled at a cooling rate of about 300° C./sec. By this heat treatment, the stainless steel was quench-hardened to a Vickers hardness of 400 or more, and at the same time, a hard film composed of a TiC layer having a thickness of 1 μm, a $TiFe_2$ layer having a thickness of 2 μm formed on the TiC layer, and a TiFe layer having a thickness of 2 μm formed on the $TiFe_2$ layer, was obtained on the stainless steel.

EXAMPLE 15

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.1 mm, in which a thickness of the Ti sheet is 4 μm. After an annealing treatment was performed to the laminate at 700° C. for 2 minutes in an Ar gas atmosphere, the laminate was worked to a desired shape by bending. Subsequently, the worked laminate was heated at 950° C. for 1 minute, and then cooled at a cooling rate of 2° C./sec. By this heat treatment, the stainless steel was quench-hardened, and at the same time, a hard film composed of a TiC layer having a thickness of 1 μm, a $TiFe_2$ layer having a thickness of 1 μm formed on the TiC layer, and a TiFe layer having a thickness of 2 μm formed on the $TiFe_2$ layer, was obtained on the stainless steel.

EXAMPLE 16

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.05 mm, in which a thickness of the Ti sheet is 3 μm. After an annealing treatment was performed to the laminate at 800° C. for 30 seconds in an Ar gas atmosphere, the laminate was worked to a desired shape by drawing. Subsequently, the worked laminate was heated at 1100° C. for 30 seconds, and then cooled at a cooling rate of 100° C./sec. By this heat treatment, the stainless steel was quench-hardened, and at the same time, a hard film composed of a TiC layer having a thickness of 1 μm, a $TiFe_2$ layer having a thickness of 1 μm formed on the TiC layer, and a TiFe layer having a thickness of 1 μm formed on the $TiFe_2$ layer, was obtained on the stainless steel.

EXAMPLE 17

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.4 mm, in which a thickness of the Ti sheet is 10 μm. After an annealing treatment was performed to the laminate at 700° C. for 2 minutes in an Ar gas atmosphere, the laminate was worked to a desired shape by drawing. Subsequently, the worked laminate was heated at 950° C. for 5 minutes, and then cooled at a cooling rate of 7° C./sec. By this heat treatment, the stainless steel was quench-hardened, and at the same time, a hard film composed of a TiC layer having a thickness of 1 μm, a $TiFe_2$ layer having a thickness of 4 μm formed on the TiC layer, and a TiFe layer having a thickness of 5 μm formed on the $TiFe_2$ layer, was obtained on the stainless steel.

EXAMPLE 18

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 1 mm, in which a thickness of the Ti sheet is 12 μm. Subsequently, the laminate was heated at 1050° C. for 2 minutes, and then cooled at a cooling rate of 50° C./sec. By this heat treatment, the stainless steel was quench-hardened, and at the same time, a hard film composed of a TiC layer having a thickness of 1 μm, a $TiFe_2$ layer having a thickness of 5 μm formed on the TiC layer, and a TiFe layer having a thickness of 6 μm formed on the $TiFe_2$ layer, was obtained on the stainless steel.

EXAMPLE 19

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.04 mm, in which a thickness of the Ti sheet is 3 μm. Subsequently, the laminate was heated at 1100° C. for 30 seconds, and then cooled at a cooling rate of 20° C./sec. By this heat treatment, the stainless steel was quench-hardened, and at the same time, a hard film composed of a TiC layer having a thickness of 1 μm, a $TiFe_2$ layer having a thickness of 1 μm formed on the TiC layer, and a TiFe layer having a thickness of 1 μm formed on the $TiFe_2$ layer, was obtained on the stainless steel.

EXAMPLE 20

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.2 mm, in which a thickness of the Ti sheet is 4 μm. Subsequently, the laminate was heated at 1000° C. for 1 minute in an Ar gas atmosphere, and then cooled at a cooling rate of 10° C./sec. By this heat treatment, the stainless steel was quench-hardened, and at the same time, a hard film composed of a TiC layer having a thickness of 1 μm, a $TiFe_2$ layer having a thickness of 1 μm formed on the TiC layer, and a TiFe layer having a thickness of 2 μm formed on the $TiFe_2$ layer, was obtained on the stainless steel.

EXAMPLE 21

A martensite stainless steel having the composition shown in Table 3 was used as a substrate. Ti—0.2% Pd alloy sheets were placed directly on both sides of the substrate. The Ti—Pd alloy sheets were clad to the substrate by rolling to obtain a laminate. The laminate is further rolled to adjust a total thickness of the laminate. As a result, the total thickness of the laminate is 0.08 mm, in which a thickness of the Ti—Pd alloy sheet is 5 μm. Subsequently, the laminate was heated at 1000° C. for 30 seconds in an Ar gas atmosphere, and then cooled at a cooling rate of 50° C./sec. By this heat treatment, the stainless steel was quench-hardened, and at the same time, a hard film composed of a TiC layer having a thickness of 1 μm, a $TiFe_2$ layer having a thickness of 2 μm formed on the TiC layer, and a TiFe layer having a thickness of 2 μm formed on the $TiFe_2$ layer, was obtained on the stainless steel.

EXAMPLE 22

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.1 mm, in which a thickness of the Ti sheet is 7 μm. Subsequently, the laminate was heated at 1050° C. for 1 minute in an Ar gas atmosphere, and then cooled at a cooling rate of about 300° C./sec. By this heat treatment, the stainless steel was quench-hardened, and at the same time, a hard film composed of a TiC layer having a thickness of 1 μm, a $TiFe_2$ layer having a thickness of 3 μm formed on the TiC layer, and a TiFe layer having a thickness of 3 μm formed on the $TiFe_2$ layer, was obtained on the stainless steel. FIG. 4 shows a SEM photograph of a cross section of an intermetallic-compound coated stainless steel of this Example. FIG. 5 shows a SEM photograph of an interface portion between the stainless steel and the hard film of this Example. FIGS. 6 to 9 respectively show distributions of Fe, Cr, Ti and C concentrations measured at the interface portion of FIG. 5. These figures suggest that the TiC layer be formed between the Ti—Fe intermetallic compound layer and the substrate.

EXAMPLE 23

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the 15 laminate is 0.2 mm, in which a thickness of the Ti sheet is 10 μm. Subsequently, the laminate was heated at 1120° C. for 2 minute in an Ar gas atmosphere, and then cooled at a cooling rate of 2° C./sec. By this heat treatment, the stainless steel was quench-hardened, and at the same time, a hard film composed of a TiC layer having a thickness of 2 μm, a $TiFe_2$ layer having a thickness of 4 μm formed on the TiC layer, and a TiFe layer having a thickness of 5 μm formed on the $TiFe_2$ layer, was obtained on the stainless steel.

COMPARATIVE EXAMPLE 8

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.1 mm, in which a thickness of the Ti sheet is 10 μm. Subsequently, the laminate was heated at 1100° C. for 7 minutes in an Ar gas atmosphere, and then cooled at a cooling rate of 10° C./sec. By this heat treatment, a hard film composed of a TiC layer having a thickness of 2 μm, a $TiFe_2$ layer having a thickness of 4 μm formed on the TiC layer, and a TiFe layer having a thickness of 5 μm formed on the $TiFe_2$ layer, was obtained on the stainless steel. However, the stainless steel could not be quench-hardened to a Vickers hardness of 400 or more. As a reason for the inconvenience, it is believed that a reaction between carbon of the stainless steel and Ti excessively proceeded for such an extended time period of the heat treatment, so that the carbon content in the stainless steel decreased.

COMPARATIVE EXAMPLE 9

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.1 mm, in which a thickness of the Ti sheet is 2 μm. Subsequently, the laminate was heated at 1050° C. for 15 seconds in an Ar gas atmosphere, and then cooled at a cooling rate of 10° C./sec. By this heat treatment, a TiC layer having a thickness of 0.5 μm was obtained on the stainless steel. However, no intermetallic compound layer between Ti and Fe was confirmed. In addition, since the thermal treatment was performed for such a short time, the laminate could not be uniformly heated. By this reason, the stainless steel could not be quench-hardened to a Vickers hardness of 400 or more.

COMPARATIVE EXAMPLE 10

The same laminate as Comparative Example 8 was prepared. The laminate was heated at 870° C. for 5 minutes, and then cooled at a cooling rate of 10° C./sec. By this heat treatment, a hard film composed of a TiC layer having a thickness of 0.5 μm, a $TiFe_2$ layer having a thickness of 3 μm formed on the TiC layer, and a TiFe layer having a thickness of 3 μm formed on the $TiFe_2$ layer, was obtained on the stainless steel. However, since the thermal treatment was performed at such a low temperature, the stainless steel could not be quench-hardened to a Vickers hardness of 400 or more.

COMPARATIVE EXAMPLE 11

The same laminate as Comparative Example 8 was prepared. The laminate was heated at 1170° C. for 30 seconds, and then cooled at a cooling rate of 10° C./sec. By this heat treatment, a hard film composed of a TiC layer having a thickness of 2 μm, a $TiFe_2$ layer having a thickness of 3 μm formed on the TiC layer, and a TiFe layer having a thickness of 5 μm formed on the $TiFe_2$ layer, was obtained on the stainless steel. However, the stainless steel could not be quench-hardened to a Vickers hardness of 400 or more. As a reason for the inconvenience, it is believed that since the heat treatment was performed at such a high temperature more than 1150° C., an excess amount of Ti diffused into the stainless steel and reacted with carbon of the stainless steel, so that the carbon content in the stainless steel decreased.

COMPARATIVE EXAMPLE 12

The same laminate as Comparative Example 8 was prepared. The laminate was heated at 1050° C. for 2 minutes, and then cooled at a cooling rate of 0.5° C./sec. By this heat treatment, a hard film composed of a TiC layer having a thickness of 1 μm, a $TiFe_2$ layer having a thickness of 4 μm formed on the TiC layer, and a TiFe layer having a thickness of 5 μm formed on the $TiFe_2$ layer, was obtained on the stainless steel. However, since the cooling rate was too slow, the stainless steel could not be quench-hardened to a Vickers hardness of 400 or more.

COMPARATIVE EXAMPLE 13

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.05 mm, in which a thickness of the Ti sheet is 3 μm. After an annealing treatment was performed to the laminate at 850° C. for 1 minute in an Ar gas atmosphere, the laminate was worked to a desired shape by bending. However, cracks occurred at the worked portions of the laminate. As a reason for this inconvenience, it is believed that since the annealing treatment was performed at such a high temperature more than 800° C., the formation of a TiC layer and an intermetallic compound proceeded in the laminate, so that the laminate could not sustain the plastic deformation. Therefore, a subsequent heat treatment for forming a hard film was performed.

COMPARATIVE EXAMPLE 14

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.1 mm, in which a thickness of the Ti sheet is 4 μm. After an annealing treatment was performed to the laminate at 650° C. for 2 minutes in an Ar gas atmosphere, the laminate was worked to a desired shape by bending. However, cracks occurred at the worked portions of the laminate. As a reason for this inconvenience, it is believed that since the annealing temperature was too low, work hardening caused by the rolling at the preparation of the laminate was not sufficiently removed from the laminate, so that the cracks occurred at the worked portions. Therefore, a subsequent heat treatment for forming a hard film was performed.

COMPARATIVE EXAMPLE 15

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.05 mm, in which a thickness of the Ti sheet is 3 μm. After an annealing treatment was performed to the laminate at 700° C. for 5 minutes in an Ar gas atmosphere, the laminate was worked to a desired shape by bending. However, cracks occurred at the worked portions of the laminate. As a reason for this inconvenience, it is believed that since the annealing treatment was performed at 700° C. for such an extended time period, the formation of a TiC layer and an intermetallic compound proceeded in the laminate, so that the laminate could not sustain the plastic deformation. Therefore, a subsequent heat treatment for forming a hard film was performed.

COMPARATIVE EXAMPLE 16

A martensite stainless steel having the composition shown in Table 3 was used as a substrate. Ti sheets were placed directly on both sides of the substrate. The Ti sheets were clad to the substrate by rolling to obtain a laminate. The laminate is further rolled to adjust a total thickness of the laminate. As a result, the total thickness of the laminate is 0.1 mm, in which a thickness of the Ti sheet is 4 μm. After an annealing treatment was performed to the laminate at 700° C. for 5 seconds in an Ar gas atmosphere, the laminate was worked to a desired shape by bending. However, cracks occurred at the worked portions of the laminate. As a reason for this inconvenience, it is believed that since the annealing time was too short, work hardening caused by the rolling at the preparation of the laminate was not sufficiently removed from the laminate, so that the cracks occurred at the worked portions. Therefore, a subsequent heat treatment for forming a hard film was performed.

As shown in Examples 1 to 23, by the method of producing the intermetallic-compound coated stainless steel of the present invention, the martensite stainless steel substrate can be quench-hardened to a Vickers hardness of 400 or more, and a hard film having an outermost layer selected from the group consisting of the Ti—Ni intermetallic compound layer, Ti—Fe intermetallic compound layer, and the mixture layer of the Ti—Ni intermetallic compound and the Ti—Cu intermetallic compound, can be formed on the quench-hardened substrate. Since the hard film has a Vickers hardness of 800 or more and is excellent in corrosion resistance, the combination of the quench-hardened substrate and the hard film is suitable for structural parts such as gears and bearings, and cutting tools such as hair clippers and blades for electric shavers.

On the other hand, as shown in Comparative Examples 1 to 5 and 8 to 12, when the heat treatment condition is not adequately selected, the stainless steel substrate can not be quench-hardened to the Vickers hardness of 400 or more. In addition, when the laminate is worked to a desired shape by plastic deformation prior to the heat treatment for forming the hard film, it is necessary to perform an annealing treatment characterized by heating the laminate at 700 to 800° C. for 15 seconds to 2 minutes prior to the plastic deformation. The annealing treatment is useful to remove the work hardening from the laminate. As shown in Comparative Examples 6, 7, and 13 to 16, when the annealing treatment condition is not adequately selected, cracks will occur in the laminate. Thus, the annealing treatment is important in the method of producing the intermetallic-compound coated stainless steel of the present invention.

TABLE 1

| | Composition of Martensite Stainless Steel (wt %) | Thickness of Diffusion Layer | Structure of Hard Film: Outermost Layer (Thickness) | Structure of Hard Film: Second Layer (Thickness) | Substrate Hardness Hv | Hardness of Hard Film Hv |
|---|---|---|---|---|---|---|
| Example 1 | Fe-13.5 Cr-1.2 Mo-0.4 C-0.3 Si-0.3 Mn | 4 μm | TiNi (3 μm) | $TiNi_3$ (4 μm) | 600 | 1100 |
| Example 2 | Fe-13.5 Cr-1.2 Mo-0.4 C-0.3 Si-0.3 Mn | 1 μm | TiNi (3 μm) | $TiNi_3$ (4 μm) | 600 | 1200 |
| Example 3 | Fe-15.5 Cr-1.0 Mo-0.5 C | 7 μm | TiNi (5 μm) | $TiNi_3$ (7 μm) | 550 | 1000 |
| Example 4 | Fe-13.5 Cr-1.2 Mo-0.3 C | 3 μm | TiNi (3 μm) | $TiNi_3$ (4 μm) | 500 | 1000 |
| Example 5 | Fe-19.5 Cr-0.3 C | 1 μm | TiNi (2 μm) | $TiNi_3$ (3 μm) | 500 | 900 |
| Example 6 | Fe-13.0 Cr-0.8 C | 1 μm | TiNi (3 μm) | $TiNi_3$ (4 μm) | 650 | 1100 |
| Example 7 | Fe-13.5 Cr-1.0.Mo-0.5 C | 23 μm | TiNi (10 μm) | $TiNi_3$ (12 μm) | 550 | 950 |
| Example 8 | Fe-13.5 Cr-1.2 Mo-0.4 C | 1 μm | TiFe (4 μm) | $TiFe_2$ (3 μm) | 500 | 900 |
| Example 9 | Fe-15.5 Cr-1.0 Mo-0.5 C | 3 μm | TiFe (4 μm) | $TiFe_2$ (5 μm) | 600 | 950 |
| Example 10 | Fe-13.5 Cr-1.2 Mo-0.4 C-0.3 Si-0.3 Mn | 6 μm | TiFe (10 μm) | $TiFe_2$ (9 μm) | 600 | 850 |
| Example 11 | Fe-15.5 Cr-1.0 Mo-0.5 C | 2 μm | TiNi + TiCu (2 μm) | $TiNi_3$ + $TiCu_2$ + $Ti_2Cu_3$ (3 μm) | 600 | 1100 |
| Example 12 | Fe-15.5 Cr-0.5 Mo-0.5 C | 1 μm | TiNi + TiCu (3 μm) | $TiNi_3$ + $TiCu_2$ + $Ti_2Cu_3$ (4 μm) | 500 | 1000 |
| Example 13 | Fe-13.5 Cr-0.8 Mo-0.4 C | 5 μm | TiNi + TiCu (2 μm) | $TiNi_3$ + $TiCu_2$ + $Ti_2Cu_3$ (3 μm) | 550 | 1000 |
| Comparative Example 1 | Fe-13.5 Cr-1.2 Mo-0.4 C-0.3 Si-0.3 Mn | 0 | TiNi (3 μm) | $TiNi_3$ (4 μm) | 350 | 1000 |
| Comparative Example 2 | Fe-13.5 Cr-1.2 Mo-0.4 C-0.3 Si-0.3 Mn | 3 μm | TiNi (2 μm) | $TiNi_3$ (3 μm) | 300 | 700 |
| Comparative Example 3 | Fe-13.5 Cr-1.2 Mo-0.4 C-0.3 Si-0.3 Mn | 3 μm | TiNi (2 μm) | $TiNi_3$ (3 μm) | 350 | 750 |
| Comparative Example 4 | Fe-13.5 Cr-1.2 Mo-0.4 C-0.3 Si-0.3 Mn | 0 | TiNi (3 μm) | $TiNi_3$ (4 μm) | 350 | 900 |
| Comparative Example 5 | Fe-13.5 Cr-1.2 Mo-0.4 C-0.3 Si-0.3 Mn | — | — | — | — | — |
| Comparative Example 6 | Fe-13.5 Cr-1.2 Mo-0.4 C-0.3 Si-0.3 Mn | — | — | — | — | — |
| Comparative Example 7 | Fe-13.5 Cr-1.2 Mo-0.4 C-0.3 Si-0.3 Mn | 1 μm | TiNi (3 μm) | $TiNi_3$ (4 μm) | 350 | 1100 |

TABLE 2

| | Laminate: Total Thickness | Laminate: Outermost Layer (wt %) | Laminate: Thickness of Outermost Layer | Laminate: Intermediate Layer (wt %) | Laminate: Thickness of Intermediate Layer | Annealing Treatment | Quench Hardening Treatment | Cooling Rate (° C./sec.) |
|---|---|---|---|---|---|---|---|---|
| Example 1 | 0.1 mm | Ti | 3 μm | Ni | 8 μm | 700° C. × 2 min. | 1050° C. × 2 min. | 50 |
| Example 2 | 0.05 mm | Ti | 3 μm | Ni | 5 μm | 700° C. × 30 sec. | 1130° C. × 30 sec. | 50 |
| Example 3 | 0.1 mm | Ti-0.2 Pd | 5 μm | Ni | 13 μm | 750° C. × 1 min. | 1000° C. × 5 min. | 1 |
| Example 4 | 0.08 mm | Ti | 3 μm | Ni | 6 μm | 800° C. × 15 sec. | 930° C. × 5 min. | 20 |
| Example 5 | 0.1 mm | Ti | 3 μm | Ni | 3 μm | 800° C. × 30 sec. | 1000° C. × 2 min. | 10 |
| Example 6 | 0.1 mm | Ti | 3 μm | Ni | 5 μm | 800° C. × 1 min. | 1050° C. × 2 min. | 5 |
| Example 7 | 0.2 mm | Ti | 10 μm | Ni | 35 μm | — | 1050° C. × 3 min. | 10 |
| Example 8 | 0.05 mm | Ti | 4 μm | Fe | 4 μm | 800° C. × 30 sec. | 950° C. × 2 min. | 10 |
| Example 9 | 0.1 mm | Ti | 4 μm | Fe | 8 μm | 750° C. × 1 min. | 1050° C. × 1 min. | 5 |
| Example 10 | 0.3 mm | Ti | 10 μm | Fe | 25 μm | 800° C. × 2 min. | 1150° C. × 30 sec. | 10 |
| Example 11 | 0.05 mm | Ti | 2 μm | Ni-20 Cu | 5 μm | — | 1050° C. × 2 min. | 25 |
| Example 12 | 0.09 mm | Ti-0.2 Pd | 4 μm | Ni-25 Cu | 4 μm | — | 1000° C. × 30 sec. | 1 |
| Example 13 | 0.04 mm | Ti | 2 μm | Ni-15 Cu | 8 μm | — | 1100° C. × 5 min. | 10 |
| Comparative Example 1 | 0.05 mm | Ti | 3 μm | Ni | 5 μm | 700° C. × 30 sec. | 1170° C. × 30 sec. | 50 |
| Comparative Example 2 | 0.05 mm | Ti | 3 μm | Ni | 5 μm | 700° C. × 30 sec. | 850° C. × 5 min. | 50 |
| Comparative Example 3 | 0.05 mm | Ti | 3 μm | Ni | 5 μm | 700° C. × 30 sec. | 1050° C. × 15 sec. | 50 |
| Comparative Example 4 | 0.05 mm | Ti | 3 μm | Ni | 5 μm | 700° C. × 30 sec. | 1050° C. × 8 min. | 50 |
| Comparative Example 5 | 0.05 mm | Ti | 3 μm | Ni | 5 μm | 650° C. × 2 min. | — | — |
| Comparative Example 6 | 0.05 mm | Ti | 3 μm | Ni | 5 μm | 850° C. × 5 sec. | — | — |
| Comparative Example 7 | 0.05 mm | Ti | 3 μm | Ni | 5 μm | 700° C. × 30 sec. | 1130° C. × 30 sec. | 0.5 |

TABLE 3

| | Composition of Martensite Stainless Steel (wt %) | Thickness of TiC | Thickness of Hard Film TiFe | Thickness of Hard Film $TiFe_2$ | Substrate Hardness Hv | Hardness of Hard Film Hv |
|---|---|---|---|---|---|---|
| Example 14 | Fe-13.5 Cr-1.2 Mo-0.4 C-0.3 Si-0.3 Mn | 1 μm | 2 μm | 2 μm | 500 | 800 |
| Example 15 | Fe-13.5 Cr-0.6 C-0.2 Mo-0.2 V | 1 μm | 2 μm | 1 μm | 500 | 850 |
| Example 16 | Fe-14.0 Cr-0.5 C-0.2 Mo-0.2 V | 1 μm | 1 μm | 1 μm | 550 | 850 |
| Example 17 | Fe-14.5 Cr-0.7 C-0.2 Mo-0.2 V | 1 μm | 5 μm | 4 μm | 500 | 800 |
| Example 18 | Fe-14 Cr-1.1 C-0.2 Mo-0.2 V | 1 μm | 6 μm | 5 μm | 550 | 800 |
| Example 19 | Fe-13 Cr-0.6 C-0.1 Mo-0.1 V | 1 μm | 1 μm | 1 μm | 600 | 900 |
| Example 20 | Fe-12.5 Cr-0.5 C-1.5 Mo | 1 μm | 2 μm | 1 μm | 550 | 850 |
| Example 21 | Fe-13.5 Cr-0.6 C-0.1 Mo-0.1 V | 1 μm | 2 μm | 2 μm | 550 | 800 |
| Example 22 | Fe-13.5 Cr-0.6 C-1.2 Mo-0.3 Si-0.3 Mn | 1 μm | 3 μm | 3 μm | 550 | 850 |
| Example 23 | Fe-13.5 Cr-0.6 C-0.2 Mo-0.2 V | 2 μm | 5 μm | 4 μm | 450 | 850 |
| Comparative Example 8 | Fe-13.5 Cr-0.6 C-0.2 Mo-0.2 V | 2 μm | 5 μm | 4 μm | 300 | 850 |
| Comparative Example 9 | Fe-13.5 Cr-0.6 C-0.2 Mo-0.2 V | 0.5 μm | — | — | 350 | 600 |
| Comparative Example 10 | Fe-13.5 Cr-0.6 C-0.2 Mo-0.2 V | 0.5 μm | 3 μm | 3 μm | 350 | 500 |
| Comparative Example 11 | Fe-13.5 Cr-0.6 C-0.2 Mo-0.2 V | 2 μm | 5 μm | 3 μm | 300 | 800 |
| Comparative Example 12 | Fe-13.5 Cr-0.6 C-0.2 Mo-0.2 V | 1 μm | 5 μm | 4 μm | 250 | 700 |
| Comparative Example 13 | Fe-13.5 Cr-0.6 C-0.2 Mo-0.2 V | — | — | — | — | — |
| Comparative Example 14 | Fe-13.5 Cr-0.6 C-0.2 Mo-0.2 V | — | — | — | — | — |
| Comparative Example 15 | Fe-13.5 Cr-0.6 C-0.2 Mo-0.2 V | — | — | — | — | — |
| Comparative Example 16 | Fe-13.5 Cr-0.6 C-0.2 Mo-0.2 V | — | — | — | — | — |

TABLE 4

| | Laminate Total Thickness | Laminate Outermost Layer (wt %) | Laminate Thickness of Outermost Layer | Annealing Treatment | Quench Hardening Treatment | Cooling Rate (° C./sec.) |
|---|---|---|---|---|---|---|
| Example 14 | 0.2 mm | Ti | 5 μm | — | 950° C. × 1 min. | 300 |
| Example 15 | 0.1 mm | Ti | 4 μm | 700° C. × 2 min. | 950° C. × 1 min. | 2 |
| Example 16 | 0.05 mm | Ti | 3 μm | 800° C. × 30 sec. | 1100° C. × 30 sec. | 100 |
| Example 17 | 0.4 mm | Ti | 10 μm | 700° C. × 2 min. | 950° C. × 5 min. | 7 |
| Example 18 | 1 mm | Ti | 12 μm | — | 1050° C. × 2 min. | 50 |
| Example 19 | 0.04 mm | Ti | 3 μm | — | 1100° C. × 30 sec. | 20 |
| Example 20 | 0.2 mm | Ti | 4 μm | — | 1000° C. × 1 min. | 10 |
| Example 21 | 0.08 mm | Ti-0.2 Pd | 5 μm | — | 1000° C. × 30 sec. | 50 |
| Example 22 | 0.1 mm | Ti | 7 μm | — | 1050° C. × 1 min. | 300 |
| Example 23 | 0.2 mm | Ti | 10 μm | — | 1120° C. × 2 min. | 2 |
| Comparative Example 8 | 0.1 mm | Ti | 10 μm | — | 1100° C. × 7 min. | 10 |
| Comparative Example 9 | 0.1 mm | Ti | 2 μm | — | 1050° C. × 15 sec. | 10 |
| Comparative Example 10 | 0.1 mm | Ti | 10 μm | — | 870° C. × 5 min. | 10 |
| Comparative Example 11 | 0.1 mm | Ti | 10 μm | — | 1170° C. × 30 sec. | 10 |
| Comparative Example 12 | 0.1 mm | Ti | 10 μm | — | 1050° C. × 2 min. | 0.5 |
| Comparative Example 13 | 0.05 mm | Ti | 3 μm | 850° C. × 1 min. | — | — |
| Comparative Example 14 | 0.1 mm | Ti | 4 μm | 650° C. × 2 min. | — | — |
| Comparative Example 15 | 0.05 mm | Ti | 3 μm | 700° C. × 5 min. | — | — |
| Comparative Example 16 | 0.1 mm | Ti | 4 μm | 700° C. × 5 sec. | — | — |

What is claimed is:

1. An intermetallic-compound coated stainless steel comprising:

a substrate of a martensite stainless steel, said substrate having a Vickers hardness of 400 or more; and a hard film having a bottom surface adhered to said substrate and an exposed top surface, said hard film having an outermost layer made of a compound selected from the group consisting of a Ti—Ni intermetallic compound, Ti—Fe intermetallic compound, and a mixture of said Ti—Ni intermetallic compound and a Ti—Cu intermetallic compound.

2. The coated stainless steel as set forth in claim 1, wherein said hard film has a $TiFe_2$ layer, and a TiFe layer formed on said $TiFe_2$ layer as said outermost layer.

3. The coated stainless steel as set forth in claim 2, wherein said hard film has a TiC layer formed under said $TiFe_2$ layer.

4. The coated stainless steel as set forth in claim 1, wherein said hard film has a $TiNi_3$ layer, and a TiNi layer formed on said $TiNi_3$ layer as said outermost layer.

5. The coated stainless steel as set forth in claim 1, wherein said hard film has a mixture layer of TiNi and TiCu as said outermost layer.

6. The coated stainless steel as set forth in claim 1, wherein said martensite stainless steel contains 12 to 20 wt % of Cr, 0.3 to 0.8 wt % of C, and 2.5 wt % or less of Mo.

7. A method of producing an intermetallic-compound coated stainless steel comprising the steps of:

preparing a laminate by cladding an outer sheet made of one of Ti and a Ti alloy to a martensite stainless steel sheet through an intermediate sheet made of one of Ni, Fe and a Ni—Cu alloy; and performing a quench hardening treatment to said laminate to harden said stainless steel to a Vickers hardness of 400 or more, and form a hard film including an outermost layer made of an intermetallic compound between Ti of said outer sheet and a metal element of said intermediate sheet on said stainless steel sheet, said quench hardening treatment comprising the steps of heating said laminate at a temperature of 900° C. to 1150° C. for 30 seconds to 5 minutes, and then cooling said laminate at a cooling rate of 1° C./sec or more.

8. The method as set forth in claim 7, wherein a thickness of said outer sheet in said laminate is within a range of 1 to 10 $\mu$m and a thickness of said intermediate sheet in said laminate is 1 to 3 times of that of said outer sheet.

9. A method of producing an intermetallic-compound coated stainless steel comprising the steps of:

preparing a laminate by cladding an outer sheet made of one of Ti and a Ti alloy directly to a martensite stainless steel sheet;

performing a quench hardening treatment to said laminate to harden said stainless steel to a Vickers hardness of 400 or more, and form a hard film having a TiC layer, a $TiFe_2$ layer formed on said TiC layer, and a TiFe layer formed on said $TiFe_2$ layer as an outermost layer, on said stainless steel sheet, said quench hardening treatment comprising the steps of heating said laminate at a temperature of 900° C. to 1150° C. for 30 seconds to 5 minutes, and then cooling said laminate at a cooling rate of 1° C./sec or more.

10. The method as set forth in claim 7 or 9, wherein an annealing treatment characterized in that said laminate is heated and kept at a temperature of 700° C. to 800° C. for 15 seconds to 2 minutes is performed to said laminate prior to said quench hardening treatment.

* * * * *